United States Patent [19]

Bonnekamp et al.

[11] 4,443,184

[45] Apr. 17, 1984

[54] PROCESS AND APPARATUS FOR IGNITING A SINTER MIX

[75] Inventors: Horst Bonnekamp, Düsseldorf; Baldur Sauer, Krefeld; Heinrich Wolkewitz, Duisburg; Günter Hepp, Oberhausen; Walter Kraemer, Nuess, all of Fed. Rep. of Germany

[73] Assignee: Wistra GmbH Thermoprozesstechnik, Düsseldorf-Heerdt, Fed. Rep. of Germany

[21] Appl. No.: 328,596

[22] PCT Filed: Mar. 20, 1981

[86] PCT No.: PCT/DE81/00047

§ 371 Date: Nov. 23, 1981

§ 102(e) Date: Nov. 23, 1981

[87] PCT Pub. No.: WO81/02747

PCT Pub. Date: Oct. 1, 1981

[30] Foreign Application Priority Data

Mar. 21, 1980 [DE] Fed. Rep. of Germany ..... 3010844
Mar. 21, 1980 [DE] Fed. Rep. of Germany ..... 3010845

[51] Int. Cl.[3] ..... F27B 14/00; F27B 9/26; C22B 1/16; C21B 7/16

[52] U.S. Cl. ..... 432/13; 75/5; 266/178; 432/137

[58] Field of Search ..... 432/13, 137; 266/178; 75/5, 8

[56] References Cited

U.S. PATENT DOCUMENTS

| | | | |
|---|---|---|---|
| 2,402,339 | 6/1946 | Morgan | 432/137 |
| 3,260,513 | 7/1966 | Connell | 266/178 |
| 3,318,590 | 5/1967 | Winterling | 266/178 |
| 4,065,111 | 12/1977 | Kyto | 266/178 |
| 4,251,062 | 2/1981 | Pobuda et al. | 266/178 |

FOREIGN PATENT DOCUMENTS

| | | | |
|---|---|---|---|
| 606885 | 5/1978 | U.S.S.R. | 266/178 |

*Primary Examiner*—John J. Camby
*Attorney, Agent, or Firm*—Michael J. Striker

[57] ABSTRACT

The subject of the invention is a process for igniting a sinter mix composed of a solid fuel and sintering material on a sintering machine in which the sinter mix is passed underneath an ignition kiln with closed end and side walls and a closed hood, whereby hot flue gases are generated in the ignition kiln above the sintering material and these hot flue gases heat and ignite the surface of the sintering material by radiation and convection. A rapid, uniform and economical ignition is thereby attained in that flue gases from one or more approximately stoichiometrically operated burners are introduced into the upper region of the igniting kiln and that gases with an increased oxygen content are introduced into the lower region in such a manner that a kiln atmosphere results which, in the upper region of the igniting hood, is hotter and relatively impoverished in oxygen, while in the lower region it is cooler and relatively oxygen enriched. A further process variant provides an improvement of the ignition procedure by using a thermal insulating hood. Apparatus for carrying out the process is also described.

20 Claims, 5 Drawing Figures

PROCESS AND APPARATUS FOR IGNITING A SINTER MIX

BACKGROUND OF THE INVENTION

The present invention relates to a process for igniting a sinter mix composed of a solid fuel and a sintering material, in particular an ore reduction sintering mix on a sintering machine in which the sintering mix is passed underneath an igniting kiln having closed end and side walls and a closed top, wherein in the igniting kiln hot flue gases are generated above the sintering material and these hot flue gases heat up and ignite the surface of the sintering material by radiation and convection. The invention furthermore relates to an apparatus for carrying out such a process with an igniting kiln which is open in the downward direction with two end walls, two side walls and a top and with a sintering belt for carrying the sintering mix, movable substantially horizontally therebelow in the direction of the connecting line between the end walls, the end walls and the side walls extending downwardly into close proximity to the sintering mix so that a hood-like igniting kiln space substantially closed off from the outer atmosphere is formed.

Igniting kilns for igniting sinter mixes are frequently designed as hoods which are closed towards the top and along the sides, whilst being downwardly open. Underneath such igniting kilns the sintering mix is conveyed through in a layer thickness of approximately 40 cm. on a so-called sinter belt which conventionally is composed of an endless series of fire grid carriages in direct abutment with one another. The sintering mix, for example for steel production, is composed substantially of iron ore serving as the sintering material and coke as the solid fuel, as well as some additives which depend upon the particular steel-making process.

In order to ignite the sintering mix whilst passing underneath the igniting kiln, this is fitted with burners which generate the temperatures required for ignition. Suction shafts are provided underneath the sintering belt by means of which the combustion gases are drawn from the igniting kiln through the sintering mix.

For the economical production of a sinter which is adapted to the characteristics of the subsequent smelting process, it is important, with regard to the ignition, that the ignition takes place on the surface of the sintering material intensively and rapidly, as well as uniformly with regard to the transverse direction to the direction of conveyance. This is to be attained with the smallest possible fuel input, not only with regard to the solid fuel in the sintering mix but also with regard to the fuel for the burners in the igniting kiln which is usually gaseous or liquid. Finally, the economics of the process are substantially influenced by the possible throughput capacity of the plant which, in turn, is decisively dependent upon the quality and velocity of the ignition procedure.

Igniting kilns of the initially described type are already known in various forms of construction. For example, there are igniting kilns in which the burners are fitted in the roof or in the end walls downwardly inclined, the burner jets of the individual burners being aimed on to the surface of the sintering material. This process admittedly results in a strong heating of the surface of the sintering material but gives a non-uniform ignition because those parts of the sintering material surface which lie in the middle point of the particular burner jet are thereby heated more intensely than the regions lying between the burner jets. A modification of this mode of construction consists in that the burners are arranged in the end walls of the igniting kiln, aimed towards each other with an oblique downward inclination. This results in a flow directed towards the roof in the centre of the igniting kiln where the flue gases of the burners meet one another, by which the hot particles of sintering materials are entrained upwardly and thus result in progressively growing deposits on the roof of the kiln.

In order to overcome these disadvantages and to attain an improved ignition, a construction has already been proposed in which the burners are arranged in the two side walls of the igniting kiln and substantially horizontally. This solution thus avoids the direction of the burner jets on to the surface of the sinter bed. Heating and ignition of the surface of the sinter bed thereby takes place more by the radiation of the kiln space of the igniting kiln. However, the influence of the non-uniform temperature distribution over the long range of the individual burner jets is the same for all burners arranged one behind the other and, accordingly, once again results in different temperatures over the cross-section of the sinter material surface. Furthermore, in this form of construction, the burner jets in the case of the small width of the sinter kilns of about 2 to 5 meters, already meet each other after 1 to 2.5 meters, which implies the risk of incomplete combustion and of stirring up the sinter bed in the centre of the kiln.

It has also been described (Fred. Cappel and Alois Kilian: "Zündung von Sintermischungen", Stahl und Eisen, 94 (1974) No. 11, page 453) to elongate the igniting kiln proper and to have this followed by a so-called thermal treatment part. In this case, the burners of the inlet portion of the elongated igniting kiln are operated with an approximately stoichiometrical air ratio, whilst the burners of the outlet side, i.e. the thermal treatment part, are operated with a relatively large excess of air. As a result, in the thermal treatment part, the oxygen required for the reaction with the solid fuel is introduced into the sinter bed in a heated state, whereby the ignition throughout is improved.

In this process, maximum possible temperature for a given fuel input is attained in the section on the inlet side due to the stoichiometrical mode of operation of the burners. The oxygen required for the combustion is first introduced into the thermal treatment part in that the burners are there operated with a comparatively large excess of air. As a result, as has been recognised by the present invention, the heat generated by the burners on the inlet side is only partly utilised so that an unnecessarily high energy consumption results.

SUMMARY OF THE INVENTION

Therefore, the present invention is based upon the problem of making available a process and a device for the ignition of a sinter mixture of solid fuel and sinter material which makes possible a rapid and uniform ignition of the sinter mixture with the smallest possible investment and operating costs (energy use).

According to the invention, this problem is solved in the case of a process of the initially described type in that, into the upper region of the ignition kiln, flue gases from one or more substantially stoichiometrically operated burners are fed and that gases with an increased proportion of oxygen are passed into the lower region, in such a manner that a furnace atmosphere is obtained which, in the upper region of the ignition hood, is hotter and with diminished oxygen content and, in the lower region, is cooler and richer in oxygen.

The invention is based on the concept that the ignition process is substantially improved if the sinter mixture is exposed simultaneously to the high temperature of a substantially stoichiometrical combustion and to an adequate oxygen supply. This may be attained in accordance with the invention by the aforesaid expedients. To a stoichiometrically operated burner are fed, as is known, fuel gas and oxygen (the latter normally as a component of atmospheric air) in such a ratio that the oxygen proportion closely corresponds to the amount required for the complete combustion of the fuel. The flue gases resulting from such a combustion merely contain only small amounts of free oxygen, since this has been used up almost totally for the combustion. In the case of a stoichiometrical combustion, the highest possible temperature is achieved in the case of a given introduction of fuel and other ancillary parameters. In that these flue gases, in accordance with the present invention, are introduced into the upper region of the kiln, this upper region and, in particular, the kiln roof is thus heated to a very high temperature with a smallest possible fuel consumption.

On the other hand, in the lower region a gas with an increased oxygen content is introduced. This gas may be any desired gas mixture, subject to the important proviso that it contains an increased content of free oxygen which is suitable to accelerate the ignition process on the surface of the sinter material. Preferably, this gas mixture contains at least 5% and especially preferably at least 10% of free oxygen.

The gases with increased oxygen content fed into the lower region of the igniting kiln can, for example, be a preferably hot gas mixture from another process of the same plant. It is also possible to feed heated air or pure oxygen into the lower region of the igniting kiln. It is only essential that in the lower region of the kiln a kiln atmosphere results which, as compared with the upper region, has an increased content of free oxygen. These gases of higher oxygen content are generally considerably cooler than the flue gases from a stoichiometrical combustion in the upper kiln region. However, it was found surprisingly that the ignition process, in particular as regards the surface of the sinter mixture, is, nevertheless, improved substantially when operating according to the process of the invention. This may be explained by virtue of the fact that the heat from the upper layer of flue gas is transmitted to the sinter bed mainly by radiation. This heat radiation on to the sinter bed is absorbed only relatively slightly by the lower layer of flue gas since the latter, especially due to its excess of air, has only relatively little components which absorb thermal radiation.

The terms "upper region" and "lower region" of the igniting kiln are not limitingly intended to denote that the gases fed into the kiln must be limited to definite limits within the kiln interior. For purposes of the invention, it is merely important that the flue gases fed into the upper region of the kiln heat, in particular, the kiln roof and the gas layers there underneath to very high temperatures and that, above the sinter mixture, an atmosphere is maintained with an increased oxygen content. The transition between the two regions is necessarily gradual and dependent upon the details of the particular igniting kiln construction.

According to a preferred embodiment of the process according to the invention, the gases having the increased oxygen content, which are fed into the lower region of the igniting kiln, consist at least in part of flue gases from a combustion with an air ratio $\lambda$ equal to 2 up to equal to 5. The air ratio $\lambda$ denotes the relation between the amount of free oxygen actually fed to the burner and the amount of free oxygen required for a stoichiometrical combustion. $\lambda=1$ thus corresponds to stoichiometrical combustion, whilst a higher $\lambda$ results in a flue gas having a corresponding residue of free oxygen. This flue gas thus then has, in the desired manner, an increased oxygen content and, as found by practical experiments, when using the limits according to the invention between $\lambda$ equal to 2 and $\lambda$ equal to 5, at the same time has a temperature so high that a uniform and rapid ignition of the sinter mixture is ensured.

In a manner similar to one of the known processes, it is also possible, in a process according to the invention, according to a preferred embodiment thereof, to introduce in the inlet region of the igniting kiln more flue gases from the burners operated approximately stoichiometrically, whilst feeding in the outlet region more of the gases having an increased oxygen content. This expedient is based on the concept that for igniting the uppermost layer in the inlet region of the kiln, particularly high temperatures and relatively little oxygen is required, whilst, as the ignition process proceeds, the burning layer progressively penetrates more deeply into the deeper layers of the sinter bed and an appreciable preheating of the lower layers of the sinter mix is attained. Accordingly, it is appropriate to employ in the rearward region of the igniting kiln less heat but a somewhat increased oxygen content. The essential difference from the known process in the case of this embodiment also resides in the feature that, in the entire region of the igniting kiln, a layer of gases is maintained above the sinter mix with an increased content of free oxygen, preferably of at least about 5%.

In principle, it is possible to feed the gases in the process according to the invention to the different kiln regions in different ways. Thus, the burners operated approximately stoichiometrically may be fitted in the upper region of the kiln, for example in the side and end walls, and be operated with a comparatively low discharge velocity in order to generate the desired hot and oxygen-impoverished atmosphere in the upper region of the kiln. Similarly, nozzles or burners operated with a gas mixture in excess of the stoichiometrical ratio may be provided in the side walls or in the end walls of the igniting kiln which serve to feed the gases with increased oxygen content. However, it is not necessary for such nozzles or burners to be fitted in that kiln region in which they are to be effective. On the contrary, the burners or nozzles themselves may also be fitted in a different position, provided that the gases emerging therefrom are so directed that the desired kiln atmosphere is attained. Certain special arrangements of the burners and nozzles, which offer particular advantages, form the subject of further preferred embodiments of the invention.

In the event that a pre-existing igniting kiln is already fitted with so-called side burners, i.e. burners accommodated in the side wall of the kiln, which are operated approximately stoichiometrically at least in the inlet region of the igniting kiln and the flue gases of which are conducted approximately horizontally in parallel stream to the kiln centre, it is preferably proposed that the gases of increased oxygen content emanate from nozzles accommodated in the side wall of the kiln underneath the burners being operated approximately stoichiometrically and intermediate between these, in the longitudinal direction, and that from these, the gases having an increased oxygen content are fed horizontally or inclined to the sinter mix. By such an expedient, the advantages of the process according to the invention can be utilised at relatively low investment costs even in the case of pre-existing plants with side burners.

A particularly simple manner of construction of the igniting kiln and a particularly good uniformity of the ignition process is attained according to a particularly preferred process proposal in that the flue gases from the burners operated approximately stoichiometrically and the gases with increased oxygen content emerge from opposite side walls or from opposite end walls of the kiln, which is particularly advantageous in the case of kilns which are not too long. The flue gases from the burners operated approximately stoichiometrically should thereby be aimed at the roof of the igniting kiln, namely, at an angle of up to 30°, angles in the range of 5° to 10° thereby having been found to be particularly advantageous. At the same time, the gases with increased oxygen content are to be aimed at an angle of at the most 50°, preferably of 20° to 35°, in relation to the horizontal, downwardly on to the sinter mix. Due to this counter-current of the gas flows, there is, in all, obtained a circulating flow in the igniting kiln, as will be explained more fully in another place.

It is to be particularly stressed that this circulating flow is also attained if the two gas flows are each fed in horizontally, in which case, however, the flue gas flow from the approximately stoichiometrical combustion is introduced in the upper region of the kiln, in particular in the region of the kiln roof, and the gas flow with increased oxygen content is introduced in the lower kiln region, in particular close to the sinter mixture. This embodiment also results in a circulating gas flow. An embodiment in which the angle in relation to the horizontal for one or both of the gas flows amounts to 0° is, therefore, expressly included within the aforedescribed embodiment.

According to a further preferred process proposal, the flue gases from an approximately stoichiometrical combustion and possibly also the gases with increased oxygen content are each introduced from the roof of the kiln in such a manner that the distribution of the kiln atmosphere according to the invention is attained. The feeding from the roof is especially advantageous if a particularly long igniting kiln is employed. It is known that the capacity of an igniting kiln, i.e. the throughput of sinter mix per unit of time, is directly dependent upon the speed with which the sinter belt is operated. However, since the ignition procedure, i.e. the penetration of the burning layer of solid fuel through the entire layer thickness of the sinter mix, requires a certain amount of time, it is necessary to employ correspondingly long igniting kilns for high capacities. In this case, the fitting of the burners and nozzles in the end walls, which is especially advantageous for short igniting kilns, is disadvantageous in that it may become impossible to maintain a uniform flow in a very long igniting kiln. Laterally fitted burners may be disadvantageous in that the uniformity of the ignition across the width of the sinter belt is inadequate. These disadvantages are removed by feeding the gases from the roof, it being possible, in this case, to adapt the feed rate not only of the flue gases from the approximately stoichiometrical combustion but also of the gases containing excess oxygen very accurately to the particular process over the entire kiln length. This embodiment will also be described more fully in conjunction with a corresponding apparatus.

For solving the problem stated further above, according to a further process proposal according to the invention, it is suggested that the sinter mix, immediately after the ignition procedure which takes place in the igniting kiln, is conveyed through a zone in which it is substantially screened from the flue gases of the ignition zone and is permeated by a flow of an oxygen-containing gas, in particular air, whilst being substantially insulated in the upward direction against thermal radiation.

This proposal according to the invention is to be used independently from the above-described measures. It results in a substantial improvement of the ignition and substantial energy savings even with conventional igniting kilns. However, it is particularly advantageous for both process proposals according to the invention or the corresponding apparatus means, respectively, to be employed in combination.

By virtue of the sinter mixture being subsequently fed in directly to the actual igniting kiln into a region in which it is well insulated thermally in the upward direction and is, at the same time, permeated by a flow of oxygen containing gas which is substantially free of flue gases, the ignition process is particularly improved insofar as the upper layers of the sinter mix in this zone are thoroughly ignited throughout.

For explaining the advantages of this measure according to the invention, it must be pointed out that the entire sinter process takes place on a sinter belt which may, for example, be more than 100 m. long, only the first part being covered by an igniting kiln which is usually about 10 to 15 m. long. This distance suffices for the ignition of the uppermost layer of the sinter mix below the igniting kiln. The length of the sinter belt and the velocity of its movement are then so selected that, at the end of the sinter belt, the burning layer has travelled through the entire thickness of the sinter mix from above down below.

In the known processes, these conditions resulted in an impairment of the upper layers of the sinter mixture in that these, in contradistinction to the lower layers, were not subjected to a prolonged preheating process prior to their being ignited. Thus, whereas the layers lying further down are only ignited comparatively late on the sinter belt and were previously preheated for a prolonged period by the hot flue gases from the upper layers, the upper layers are ignited in a virtually cold state. In order to attain, nevertheless, an adequate sintering of the uppermost layers, it was necessary, in the known processes, to adapt the addition of solid fuel to these uppermost layers. For the layers lying further below, excess solid fuel was present which was burnt off substantially uselessly.

In order to improve this state of affairs, it was already known to use the already initially mentioned elongated igniting kilns which are fitted with side burners and the rearmost region on the outlet side of which served as a heat treatment zone. The burners there present are operated with excess air and thus provide for a heating up of the sinter material in this after-treatment region, thus making it possible also to sinter the upper layers of the sinter mix with a comparatively low consumption of solid fuel.

Within the scope of the present invention, it has now been found that a sinter which, in respect of the quality of the sinter material and of the solid fuel used, is at least comparable, can be attained with a considerably reduced expenditure of energy by making use of the above-described process features.

A corresponding apparatus of the initially described type is characterised in that a thermally insulating hood immediately following the ignition kiln is provided having thermally insulating walls which are opened downwardly towards the sinter machine, the side and end walls which extend close to the sinter mixture and the roof of which has passages therethrough for sucking in combustion air. The combustion air, as is conventional with known apparatus, is thereby sucked in through suction shafts underneath the fire grid carriages of the sinter belt and thus flows through the entire sinter mixture.

Advantageously, the combustion air may already have been preheated elsewhere in the process, i.e. in the context of any exothermal process steps in the same plant. The cooling bed of the sintering machine is, for example, suitable for this purpose. This is so because the completed sinter is dropped at the end of the sinter belt on to a sinter cooler through which air is drawn. In the course thereof, this air is heated substantially but, in contradistinction to the air which has flowed through the sinter belt, only contains very little flue gases, because no combustion takes place any more on the cooling bed. This preheated air is particularly well suited for use in the in the remainder of the process. It may, in particular, also be used advantageously as preheated combustion air for the burners in the igniting kiln.

The advantageous effect of using a thermal insulating hood depends particularly on the fact that the thermal radiation from the surface of the sinter material to the environment in the region of the thermal insulation hood is substantially suppressed and is utilised in heat exchange with the combustion air drawn in.

In the known constructions, including also those with a so-called thermal treatment part, the surface temperature of the sinter material after leaving the igniting kiln still amounts to many 100° C. As a result, after leaving the igniting kiln, heat is lost by radiation to a substantial degree with the known harmful consequence that the upper region of the sinter bed is poorly sintered. Furthermore, it is an advantage that in the thermal insulation hood according to the invention, only air is present which is not highly contaminated by flue gases. This is advantageous for the spreading of the combustion into the regions lying below the surface.

It is further proposed that the passages through the roof of the thermal insulating hood are so designed that they are composed of stationary parts and of upwardly and downwardly movable parts provided thereabove. The latter parts are thereby made wider than the gaps between the stationary parts so that they overlap these gaps. As a result, there is no straight-line connection between the sinter surface and the environment. By this construction, the direct radiating away of heat from the surface of the sinter material to the environment is avoided also in the region of the passages for drawing in the combustion air. In this manner, the thermal loss from the surface of the sinter bed is further reduced in the desired manner.

It is, furthermore, possible to adjust the size of the passsages for the combustion air. In this manner, the pressure in the thermal insulating hood can be so adjusted that, on the one hand, the drawing in of combustion air takes place substantially through the passages in the roof and thereby a uniform flow distribution in the thermal insulating hood is produced, whilst only a minor portion of the air is sucked in through the unavoidable leakage regions between the sinter grid carriages and the thermal insulating hood and between the sinter beds and the outlet end wall of the thermal insulation hood. The aperture is thereby, in ease case, adjusted to be only as large as is necessary.

The invention, in particular the apparatus proposals according to the invention, are, in the following further explained in more detail, with reference to preferred embodiments illustrated in the drawing.

DETAILED DESCRIPTION OF THE PREFERRED EMBODIMENTS

Figure 1:
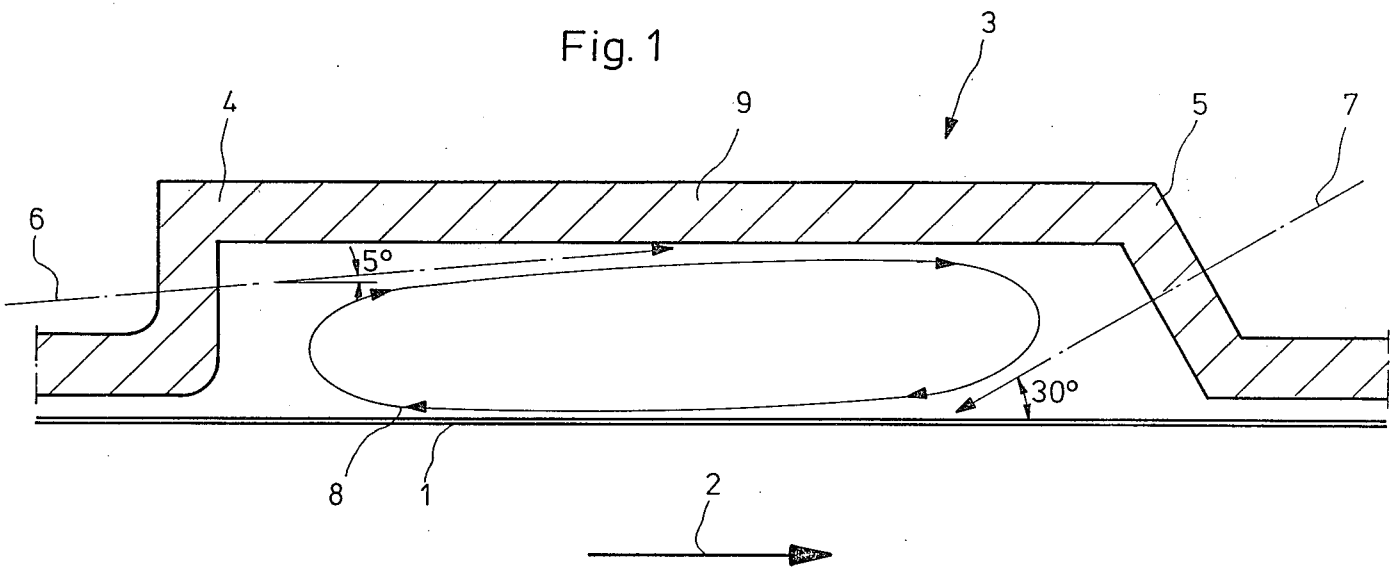
FIG. 1 shows an igniting kiln according to the invention in a longitudinal section.

In FIG. 1, the upper edge 1 of a sinter mixture can be seen. The sinter mix moves in a direction denoted by the arrow 2 at a rate adapted to the particular process through an igniting kiln which in its entirety is denoted by the reference number 3. The sinter mix is, in a known manner, present on a sinter belt formed by fire grid carriages and has a thickness of normally about 40 cm. In the drawing, these known details are not illustrated for purposes of clarity.

The igniting kiln consists of a roof 9, an end wall 4 on the inlet side and an end wall 5 on the outlet side. The side walls in FIG. 1 extend parallel to the plane of the paper and essentially vertically to the sinter belt along its edges. Altogether, the igniting kiln 3 thus forms a space closed by a hood-like structure. The end walls 4 and 5, as well as the side walls which are not illustrated in the Figure extend downwardly in a known manner into close proximity above the surface of the sinter mix 1. The roof 9 of the igniting kiln and also its walls are thermally insulated in a known manner. In the illustrated embodiment, a series of burners are accommodated in the end walls 4 and 5 having burner axes which, in the Figure, are denoted by the reference 6 for the burners on the inlet side and 7 for the burners for the outlet side. The number of the burners provided on each of these sides is determined by their capacities, the width of the sinter belt and other factors and is not subject matter of the invention. In any case, in the illustrated preferred embodiment, all burners on the inlet side, on the one hand, and all burners on the outlet side, on the other hand, are parallel in their axial direction and are uniformly distributed over the width of their respective end walls.

In the illustrated embodiment, as is to be seen in the Figure, the burners on the inlet side are directed at the roof of the igniting kiln 3 at an angle of 5° to the horizontal. The burners on the outlet side are aimed at an angle of 30° in relation to the horizontal downwardly on to the surface of the sinter mix. Due to this orientation of the burner rows on the inlet and outlet side, respectively, there results a circulatory flow which is schematically indicated in the drawing by the reference 8.

It is essential to the invention that the burners on the inlet side are operated with an approximately stoichiometrical ratio of fuel and oxygen, whereas in the case of the burners on the outlet side, the ratio of fuel and air is so adjusted that an air ratio larger than 1.3 is maintained. These air ratios are maintained in the case of both rows of burners in conventional manner by means of suitable valves and regulating devices which are not illustrated in the Figure since they are not essential to the invention.

The generation of the revolving pattern of flue gases in the igniting kiln is further improved in that, according to a preferred embodiment, the burners on the inlet side are designed in a manner known per se to produce short flames, whereas the burners on the outlet side are designed to generate long flames.

In the embodiment illustrated in the drawing, the end wall 5 on the outlet side is oriented vertically to the associated burner axis 7. This is advantageous, particularly in the case of comparatively large inclinations of the burner axes, in order to permit a simple fixing of the burners in the respective wall and a neat guidance of the flue gases.

The preferred type of construction offers the following advantages:

The formation of a congestion in the centre of the kiln 3 due to the flue gas flow brought about by the burner jets and resulting upward entrainment of heated particles of the sinter bed 1, which in turn would result in undesirable deposits, is avoided. On the contrary, not only the burners on the inlet side but also those on the outlet side operate in such a manner that a revolving pattern 8 of flue gas in the igniting kiln 3 results, the direction of rotation of which is maintained in the same direction by both rows of burners. This revolving pattern 8 has the result that the hot flue gases of the burners on the inlet side generated by the stoichiometrical combustion flow along the roof 9 of the igniting kiln 3 from the inlet side to the outlet side such that they transmit their heat at the prevailing temperatures predominantly by direct radiation to the sinter mix 1 and, by indirect radiation by way of the radiational heating up of the roof 9, also to the sinter mix 1. Thus it is avoided that the individual burner jets are directed on to the sinter bed 1 which would bring about the described non-uniformity of heating. On the contrary, the heat transfer takes place in the described manner substantially by the thermal radiation of all of the gases and the kiln roof 9 in the upper region of the igniting kiln 3, whereby the uniformity of heating is ensured.

It is, furthermore, of advantage that any non-uniformities of heating arising in a direction transverse to the conveying direction of the sinter machine can be compensated for by differently feeding the individual burners mounted one beside the other in the end wall. If it is found, for example, that the two outerlying edges of the belt are heated up too little, it is possible to accordingly feed the two outerlying burners in the end wall more intensely.

The solution according to the invention thus combines the advantage of uniform heating by radial heat transfer from the upper region of the igniting kiln with the possibility of influencing the heat application to the zones which, viewed in the direction of transport, are arranged one beside the other. This is important because, for the production of a uniform sinter material, it is not only necessary for the entire sinter bed 1 to be heated uniformly but, in addition, it is necessary to adapt the heating to possible differences in the heat requirements of the various zones of the sinter bed which adjoin one another in the direction of transport. As regards the burners on the outlet side which, in a manner known per se, are obliquely downwardly inclined and are operated with excess air, there exists, on the other hand, no risk of uneven heating. Since these heaters are operated with a comparatively large air excess, the extent to which the temperature of the flue gases exceed the surface temperature of the sinter bed 1 in this region is only slight so that substantially no further heating results from these burners. The purpose of these burners is, on the contrary, the making available of hot gases with increased oxygen content, which is necessary for the reaction with the solid fuel of the sinter mix. It is particularly important that the described revolving body of flue gas in the igniting kiln brings about the formation according to the invention of two superimposed layers of streams of flue gas. The upper layer of hot stoichiometrical flue gases derived from the burners on the inlet side thereby brings about the heating up of the sinter bed by radiation, whereby the density of the thermal flow and the temperature, due to the amount of transferred heat, decreases from the inlet side to the outlet side. On the other hand, the lower flow of less strongly heated but oxygen rich gases derived from the burners on the outlet side serves to make available the oxygen required for the reaction of the solid fuel. The thermal radiation of the upper layer of flue gas on to the sinter bed is thereby absorbed only relatively slightly by the lower layer of flue gas, particularly since, due to its high air excess, the latter has only relatively few flue gas components which absorb thermal radiation. The particular advantage of this preferred type of construction is, therefore, the making available of a high and uniform density of heat flow for the ignition and the simultaneous admission of heated oxygen required for the combustion of the solid fuel. Accordingly, a rapid and uniform ignition is brought about by the making available of appropriately heated combustion air. After the first ignition event on the surface, the temperature and thus the sintering of the uppermost layer of the sinter bed continues to improve. In this manner, the disadvantageous effect of incomplete sintering in the uppermost layer applicable to known constructions is completely avoided. Since, as a result, the upper layer can also be used as finished sinter, the throughput capacity of the plant and the specific heat consumption per tonne of finished sinter are reduced.

The last-mentioned advantages can also be attained, in principle, by means of other apparatus in which the process steps described further above are maintained. Accordingly, the preferred embodiments of the apparatus for carrying out the process according to the invention here described are to be understood only as specially preferred embodiments which lead to particularly advantageous results, depending on prevailing requirements.

Figure 2:
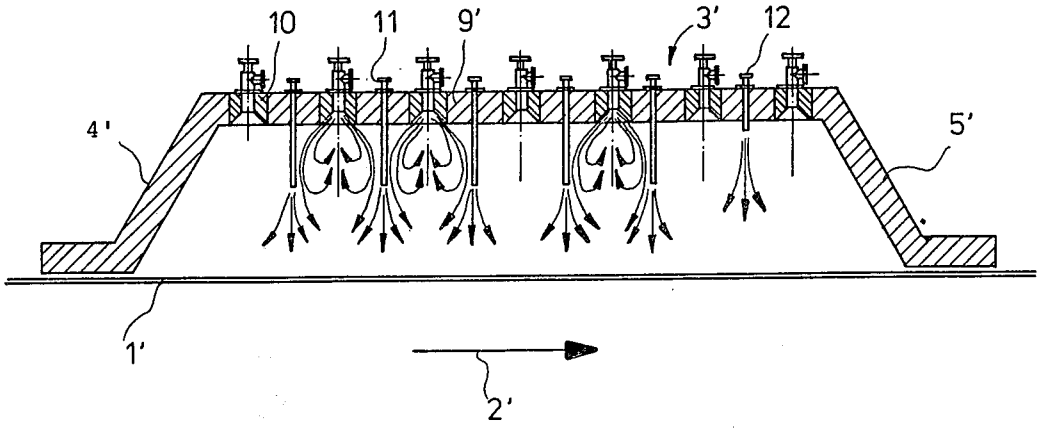
FIG. 2 shows a further embodiment of an igniting kiln according to the invention in longitudinal section.
Figure 3:
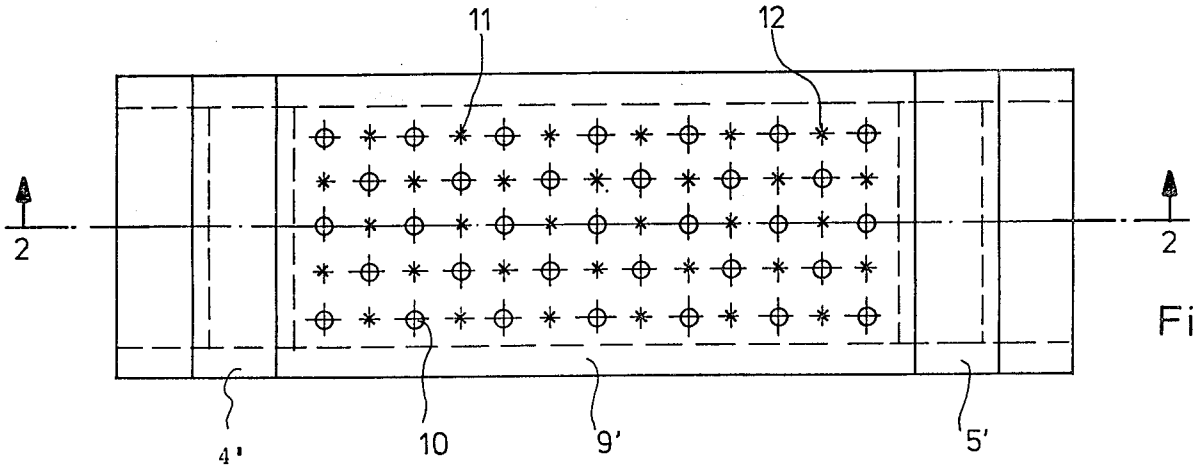
FIG. 3 is a schematic view from below of the roof of a kiln according to FIG. 2.

A further thus preferred embodiment is illustrated in FIGS. 2 and 3. Those components which correspond to the previously described embodiment are thereby denoted by the same reference number but marked with an additional prime.

The essential feature of the apparatus illustrated in FIGS. 2 and 3 resides in that not only the burners for feeding the flue gases derived from approximately stoichiometrical combustion but also the nozzles for feeding the gases having an increased oxygen content pass through the roof of the kiln. There can be seen roof burners 10, roof nozzles of long construction 11 and roof nozzles of short construction 12.

The roof burners 10 are preferably made in the form of so-called roof jet burners. This per se known burner type is characterised in that the media (fuel and air) leave the burner with a certain spin as a result of the configuration of the burner nozzles. The flow lines of the media, after leaving the burner, spread spirally downwardly and outwardly. This results, on the one hand, in a short flame and, on the other hand, in a suction effect in the centre of the burner, by means of which the media or flue gases in the centre of the spiral as drawn upwardly. The principle form of the flow lines is illustrated in FIG. 2 to the extent that it can be shown in cross-section.

It is important that, with this burner type, a very short flame and a strong heating up of the surroundings of the burner is attained. The heat is transmitted essentially by the radiation of the flue gases and of the kiln roof 9' which is heated up by the burners.

For feeding in the gases with increased oxygen content, nozzles 11 and 12 are used in the illustrated embodiment which preferably take the form of parallel flow nozzles. Depending on the details of use, these consist of a tube for air or another oxygen-containing gas mixture or of concentric pipes for fuel and air. They have smooth surfaces and are altogether so designed that the media at the ends of the nozzles emerge comparatively slowly and in a laminar flow, so that an elongate flow path on to the surface of the sinter mix is achieved. The nozzles are preferably designed as comparatively long tubes 11 or comparatively short tubes 12, the comparatively long tubes being more suitable for feeding the gases with the increased oxygen content without major mixing with the flue gases from the roof burners into the region of the sinter mix. On the other hand, the tubes should not be of any desired length since they will otherwise be subjected to excessive wear. The length and the design of these nozzle tubes is dependent upon each individual case and is readily available to any expert, the only consideration being, in this case too, that the layer formation of gases according to the invention in the igniting kiln is achieved.

FIG. 3 shows clearly that the roof jet burners 10 and the roof nozzles 11 and 12 are arranged in a chessboard pattern and so staggered in relation to one another that the roof nozzles 11, 12 in each case lie in the centres of the squares which are formed by the roof jet burners serving as end points. By means of such a uniformly alternating distribution of the roof nozzles and roof jet burners, there is achieved a particularly uniform ignition of the surface of the sinter mix.

The individual rows of burners arranged in the direction of movement of the sinter belt one behind the other, may also be operated with different amounts of fuel and air, perhaps in that the throughput flow rates diminish towards the outlet side. However, obviously it is also possible to vary the spacing of the rows of burners from one another in an appropriate manner.

As already described further above, one embodiment with admission of flue gases or gases having an increased oxygen content through the roof of the kiln is of advantage, particularly for long igniting kilns, where such an embodiment also permits a particularly accurate setting of the temperature distribution not only across the width of the sinter belt but also especially over the length of the igniting kiln.

A preferred variant of the apparatus according to the invention is characterised in that for feeding in the gases with increased oxygen content, tubes are provided which extend between the side walls of the igniting kiln. These tubes have nozzles from which the gases emerge substantially in a downward direction, be it inclined or completely vertically. In the case of special applications, it may also be advantageous to provide for a horizontal gas flow from the tubes. Furthermore, in particular instances of use, it is appropriate for the tubes not to pass continuously from one side wall to the other but for them to project merely a certain distance from one side wall or also end wall into the kiln space.

Figure 4:
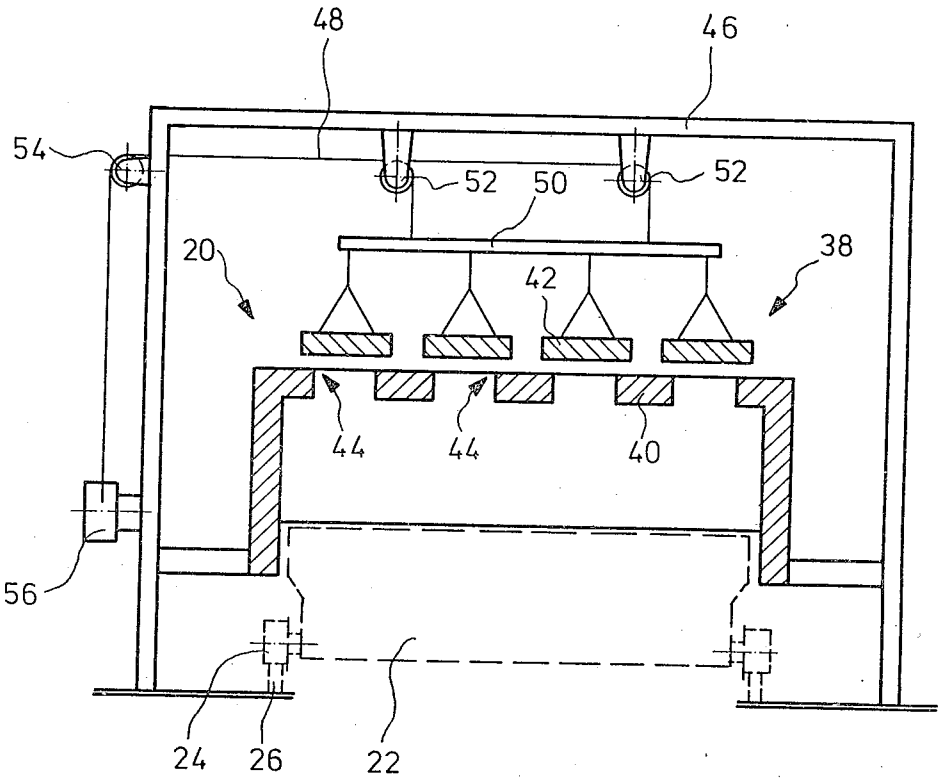
FIG. 4 is a transverse section through a thermal insulating hood according to the invention in schematic illustration.
Figure 5:
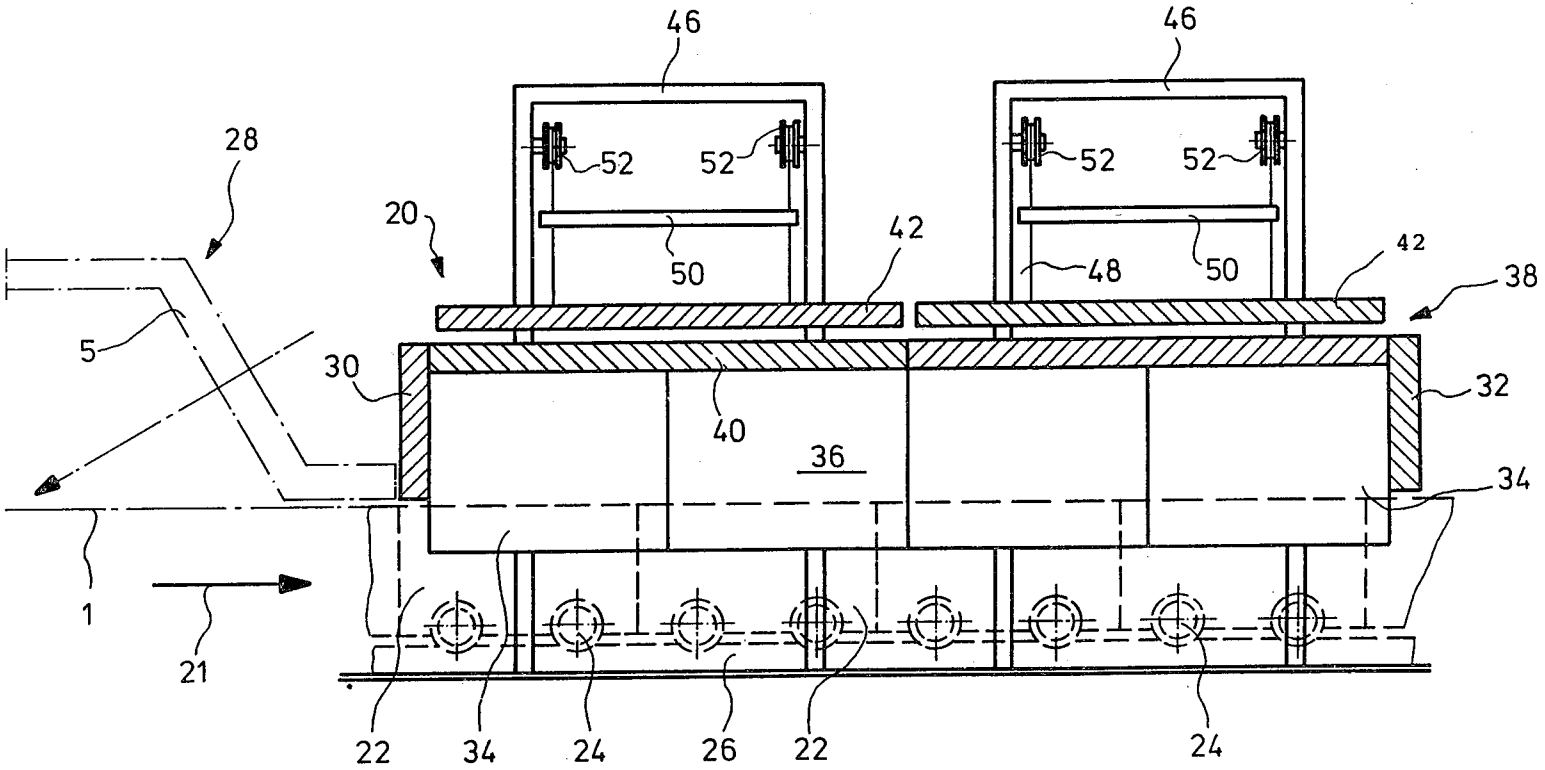
FIG. 5 is a longitudinal section through a thermal insulating hood according to FIG. 4.

FIGS. 4 and 5 illustrate schematically in cross-section and longitudinal section, respectively, a thermal insulating hood according to the invention which, in its totality, is denoted by the reference 20.

Underneath the thermal insulating hood the sinter belt moves in the direction of the arrow 21, as is to be seen in FIG. 5. The essential parts of the sinter belt are indicated by broken lines. These are the fire grid carriages 22 which travel with wheels 24 on rails 26. Similarly illustrated by broken lines is the outlet end 28 of an igniting kiln. This igniting kiln can be of conventional design. However, a kiln in accordance with the invention as described before is preferably used.

The thermal insulating hood 20 has two end walls 30 and 32, a side wall 36 composed of a plurality of side wall members 34 and a roof 38.

The roof 38 is composed of stationary parts 40 and upwardly and downwardly movable parts 42. As is to be seen from FIG. 4, the upwardly and downwardly movable parts 42 are of wider horizontal dimensions than are the gaps between the stationary parts 40. The movable parts 42 thus overlap the stationary parts 40. All walls 30, 32, 36 and 38 of the thermal insulating hood 20 are thermally insulated in known manner. Due to the overlapping construction of the roof members 40 and 42, it is achieved that the thermal losses under the thermal insulating hood, insofar as they arise from radiation, are also substantially prevented when the passages 44 in the roof 38 are opened.

Thus, the thermal insulating hood brings about a good thermal insulation above the sinter mix contained in the fire grid carriages 22. Under the fire grid carriages, the suction shafts, which are not illustrated in the drawing, are provided for the purpose of drawing in oxygen-containing gases, especially air, through the sinter mix. This air can enter through the passages 44 in the thermal insulating hood 20. Depending on the circumstances of the particular plant, this air may be preheated earlier in the process. In any event, the thermal insulating hood permits the creation of a controlled and thermally insulated atmosphere in the zone of a sintering machine which immediately follows the igniting kiln. It has been found that, due to this expedient, the ignition of the surface of the sinter mix is improved decisively or the fuel requirement therefor can be reduced substantially.

The construction for adjusting the thermal insulating hood according to the invention, is illustrated only schematically in FIGS. 4 and 5. It essentially comprises a frame 46, from which, by means of ropes 48, a common carrier beam 50 for the various movable roof members 42 is suspended. This rope 48 passes over carrier pulleys 52 and deflecting pulleys 54 which are fitted on to the frame 46. A schematically indicated winch 56 is provided for operating the rope 48. This winch 56 can be so controlled that the movable members 42 can be brought into and arrested at any desired distance from the stationary members 40 of the roof 38.

The stationary members 40 of the roof 38, as well as the end walls 30 and 32 and the elements 34 of the side walls 36 are mounted stationarily above the sinter belts by a construction which is not illustrated in the drawing in detail but which is familiar to the expert. It is important that the side and end walls extend into close proximity to the sinter mix so that the space underneath the thermal insulating hood 20 is substantially shut off.

Practical experiences show that with a sinter plant operated in accordance with the process of the invention and with the apparatus according to the invention, an increased capacity, a sinter of improved quality and a substantial energy saving can be attained. An example of this is given in the following:

A conventional plant had an igniting kiln with two rows of burners each with nine burners accommodated in the end walls and directed obliquely downwardly on the inlet and outlet side on to the sinter mix. This plant according to the state of the art was then reconstructed: instead of the igniting kiln present, an igniting kiln according to FIG. 1 was substituted and a connecting thermal insulating hood according to FIGS. 4 and 5. As a result of the expedients according to the invention, it was possible to reduce the gas consumption of the plant from 27.4 normal cubic meters per tonne of finished sinter ($m_n^3/t$) to 13.1 $m_n^3/t$. The coke consumption was reduced from 61.0 kg/t of finished sinter to 47.7 kg/t. The investigation of the finished sinter obtained showed that its quality characteristics were at least equivalent, in spite of the considerably reduced energy input, and had even been improved in certain important aspects, for example the mechanical strength of the sinter.

We claim:

1. Process for igniting a sintering mix consisted of a solid fuel and a sinter material, especially a sinter smelting mixture, in a sintering machine having an igniting kiln having two closed end walls, side walls and a closed roof, comprising the steps of providing in the kiln a first group of burners which operate approximately stoichiometrically and providing in the kiln a second group of burners, passing a sintering mix underneath the igniting kiln substantially horizontally from an inlet end wall to an outlet end wall; and introducing into an upper region of the kiln flue gases from said first group of burners and introducing from said second group of burners flue gases with an increased oxygen content into a lower region of the kiln in such a manner that a kiln atmosphere results which, in the upper region of the igniting kiln, is hotter and of diminished oxygen content, whilst in the lower region it is cooler and more oxygen-enriched, whereby hot flue gases are generated above the sintering mix and are heated up and ignite the surface of the sintering mix by radiation and convection.

2. Process according to claim 1, wherein the gases introduced into the lower region contain more than 5% free oxygen.

3. Process according to claim 2, wherein the gases introduced into the lower region include flue gases from a combustion with an air ratio $\lambda$ of between 2 and 5.

4. Process according to claim 3, wherein in an inlet region of the igniting kiln, more of the flue gases are introduced from the burners operated approximately stoichiometrically and in an outlet region more of the gases with increased oxygen content.

5. Process according to claim 4, wherein the flue gases introduced by the burners operated approximately stoichiometrically are conducted coming from the side walls of the igniting kiln, approximately horizontally in parallel flows, the gases with increased oxygen content being introduced through nozzles arranged underneath the approximately stoichiometrically operated burners and horizontally to the sinter mix.

6. Process according to claim 1, wherein the flue gases emanating from the approximately stoichiometrically operated burners are aimed at a first angle of at most 30° to the horizontal from one end wall up against the roof of the igniting kiln and the gases with increased oxygen content are aimed from the opposite end wall, at a second angle of at most 50° in relation to the horizontal, downwardly against the sinter mix so as to flow over the sinter mix, which results in a circulating gas flow in the igniting kiln.

7. Process according to claim 1, wherein the flue gases introduced into the upper region of the kiln through the approximately stoichiometrically operated burners are introduced from the roof of the igniting kiln so that they spread out substantially only in the upper region of the igniting kiln and wherein the gases introduced into the lower region of the igniting kiln with increased oxygen content are introduced from the roof of the igniting kiln so that they spread substantially in the lower region of the igniting kiln over the sinter mix.

8. Process according to claim 7, wherein the flue gases introduced from the roof of the igniting kiln through approximately stoichiometrically operated burners are fed through roof jet burners fitted in a manner known per se in the roof of the igniting kiln with vertical axes due to an appropriate spin of the media in the burners in such a manner that the media first move away downwardly from the burner in a spiral movement with a hollow core and then to a major part flow back upwardly to the burner, centrally along the burner axis and in this manner are recirculated, the tangential and axial velocities of the media in the burners in a manner known per se being so large that the resulting circulatory flows substantially occupy only the upper two-thirds of the clear height between the sinter bed and the roof of the igniting kiln and the gases with increased oxygen content being introduced through nozzles passing through the roof in a manner known per se as parallel flows with an approximately vertical flow direction of low velocity of approximately 5–30 m/sec, being downwardly blown-in so that they spread out in the lower region of the igniting kiln and such along on their way from the roof to the lower region of the igniting kiln relatively little flue gases derived from the approximately stoichiometrical combustion.

9. Process according to claim 6, wherein said first angle is between 5° and 10° and said second angle is between 20° and 35°.

10. Apparatus for carrying out a process for igniting a sintering mix composed of a solid fuel and a sintering material, especially a sinter smelting mixture, in which the sintering mix is passed underneath an igniting kiln and wherein flue gases are introduced into the kiln in such a manner that a kiln atmosphere results which, in the upper region of the igniting kiln, is hotter and of diminished oxygen content, whilst in the lower region it is cooler and more oxygen-enriched, the apparatus comprising an ignition kiln (3) open in the downward direction and including two end walls (4,5), two side walls and a roof (9) and a sinter belt arranged under the kiln and movable substantially horizontally in the direction of the connecting line between the end walls, for carrying a sinter mix (1), the end walls (4,5) and the side walls extending downward into close proximity to the sinter mix so as to form a hood-like igniting kiln space which is substantially closed off from the outer atmosphere, wherein on the one end wall (4) disposed at an inlet side there are provided burners (6) extended approximately parallel to the horizontal against the igniting kiln roof and on the other end wall (5) disposed at an outlet side there are provided burners (7) which are inclined to the horizontal at up to 50° towards the surface of the mix, the burners on the inlet side being operated approximately stoichiometrically, whilst the burners on the outlet side are operated with an air ratio λ larger than 1.3.

11. Apparatus according to claim 10, wherein the end walls (4,5) each extends approximately normal to the burner axes of the burners (6, 7) provided therein.

12. Apparatus according to claim 11 wherein the burners (6) on the inlet side are of a per se known design which produces short flames, whilst the burners (7) on the outlet side are of a per se known design which produces long flames.

13. Apparatus according to claim 10, wherein the burners at the inlet side are extended with an inclination of up to 30° to the horizontal.

14. Apparatus for carrying out a process for igniting a sintering mix composed of a solid fuel and a sintering material, expecially a sinter smelting mixture, in which the sintering mix is passed underneath an igniting kiln and wherein flue gases are introduced into the kiln in such a manner that a kiln atmosphere results which, in the upper region of the igniting kiln, is hotter and of diminished oxygen content, whilst in the lower region it is cooler and more oxygen-enriched, the apparatus comprising a downwardly open igniting kiln having two end walls (4', 5'), two side walls and a roof (9') and a sinter belt for the accommodation of a sinter mix (1') movable substantially horizontally therebelow in the direction of the connecting line between the end walls, the end walls and the side walls extending downwardly into close proximity above the sinter mix so as to form a hood-like igniting kiln space which is substantially closed off from the ambient atmosphere; per se known roof burners (10) fitted in said roof, the feed lines of which for fuel and air comprise adjustment members permitting an adjustment or control to an air ratio approximately equal to 1; roof jet burners (10) arranged uniformly in a chessboard pattern staggered relative to one another in the longitudinal direction of the igniting kiln; nozzles (11,12) for feeding the gases with an increased oxygen content and having vertical axes and accommodated in the roof and having the form of parallel flow nozzles composed of concentric tubes for fuel and air, the cross-sections of these tubes for air and fuel gases being so dimensioned that air and fuel gases emerge with a velocity of about 9–30 m/sec., and the nozzles (11,12) being each positioned in the centre of the squares which are formed by the roof jet burners (10) as corner points.

15. Apparatus according to claim 14, wherein the nozzles (11,12) for feeding in the gases with an increased oxygen content are tubes which each pass with a vertical axis thereof through the roof (9') into the hollow interior of the igniting kiln.

16. Apparatus according to claim 15, wherein for feeding in the gases with increased oxygen content, the tubes project from the side walls of the igniting kiln into the lower region of the latter substantially horizontally, being fitted with nozzles downward directed obliquely or vertically.

17. Apparatus for carrying out a process for igniting a sintering mix composed of a solid fuel and sintering material, especially a sinter smelting mixture, in which the sintering mix is passed underneath an igniting kiln and wherein flue gases are introduced into the kiln in such a manner that a kiln atmosphere results which, in the upper region of the igniting kiln, is hotter and of diminished oxygen content, whilst in the lower region it is cooler and more oxygen-enriched, the apparatus comprising an igniting kiln (3) which is open in the downward direction and having two end walls (4,5), two side walls and a roof (9) and a sinter belt for carrying a sinter mix (1) movable therebelow substantially horizontally in the direction of the connecting line between the end walls, the end walls and the side walls extending downwardly into close proximity of the sinter mix (1) so as to form a hood-like igniting kiln space which is substantially closed off from the ambient atmosphere; and a thermal insulating hood (20) which immediately follows the igniting kiln and has thermally insulating roof and side and end walls (30, 32, 36, 38) and is downwardly open towards the sintering machine, the side walls (36) and end walls (30, 32) of said insulating hood extending downwardly into close proximity of the sintering mix and the roof (38) of said hood having passages (44) therethrough for the sucking in of combustion air.

18. Apparatus according to claim 17, wherein the size of the passages (44) for the combustion air is adjustable.

19. Apparatus according to claim 17, wherein the roof of the hood is composed of an upwardly and downwardly movable carrier part (50), of stationary parts (40) extending in the longitudinal direction of the hood and of upwardly and downwardly movable parts (42) having areas which are larger than the gaps between the stationary parts (40) so that they overlap the stationary parts and are suspended from the upwardly and downwardly movable carrier part (50) to be movable substantially vertically.

20. Apparatus according to claim 19, wherein the thermal insulating hood (20) is subdivided into a plurality of individual segments so that its length can be varied according to requirements.

* * * * *